United States Patent [19]

Moskowitz et al.

[11] 4,069,732

[45] Jan. 24, 1978

[54] ELECTRIC GUITAR

[75] Inventors: Jacob F. Moskowitz, Brookline; Ogden H. Hammond, III, Arlington, both of Mass.

[73] Assignee: Massachusetts Institute of Technology, Cambridge, Mass.

[21] Appl. No.: 611,048

[22] Filed: Sept. 8, 1975

[51] Int. Cl.[2] ..... G10H 3/00

[52] U.S. Cl. ..... 84/1.16; 84/1.14; 84/1.15

[58] Field of Search ..... 84/1.14, 1.15, 1.16, 84/297 R, 304, 1.24

[56] References Cited

U.S. PATENT DOCUMENTS

| | | | |
|---|---|---|---|
| 1,915,858 | 6/1933 | Miessner | 84/1.16 |
| 2,293,372 | 8/1942 | Vasilach | 84/1.15 |
| 2,293,806 | 8/1942 | Dawson | 84/1.16 X |
| 2,557,877 | 6/1951 | Kluson | 84/304 |
| 3,066,567 | 12/1962 | Kelly | 84/1.15 X |
| 3,084,583 | 4/1963 | Anderson | 84/1.16 |
| 3,085,460 | 4/1963 | Edwards | 84/116 X |
| 3,183,296 | 5/1965 | Miessner | 84/1.15 |
| 3,297,813 | 1/1967 | Cookerly et al. | 84/1.16 |
| 3,325,579 | 6/1967 | Cookerly et al. | 84/1.16 |
| 3,518,353 | 6/1970 | Appleton | 84/1.16 X |
| 3,983,777 | 10/1976 | Bartolini | 84/1.15 |

FOREIGN PATENT DOCUMENTS

| | | | |
|---|---|---|---|
| 113,270 | 4/1940 | Australia | 84/1.15 |

*Primary Examiner*—Ulysses Weldon

*Attorney, Agent, or Firm*—Arthur A. Smith, Jr.; Martin M. Santa; Robert Shaw

[57] ABSTRACT

An electric guitar is described which provides signals from each of its electrically conducting strings by the cutting of magnetic field lines. The magnetic fields are produced by removably mounted permanent magnets which produce concentrated fields. The return wire or wires of the strings are near the surface of the neck. Various circuit configurations are used to minimize noise pickup, to combine the signals from each signal and to modify the sound produced by each string.

17 Claims, 21 Drawing Figures

ELECTRIC GUITAR

The invention herein described was made in the course of work performed under a grant from the National Science Foundation, an agency of the United States Government.

This invention relates to electrically amplified stringed musical instruments and in particular to an instrument using strings of electrically conducting material. An example of this type of instrument is the electric guitar and for purposes of illustrating certain embodiments of the invention, the invention as incorporated in an electric guitar will be described.

Cookerly et al, U.S. Pat. Nos. 3,297,813 and 3,325,579; Vasilach, 2,293,372; Miessner, 1,915,858 and Benioff, 2,239,985 describe musical instruments which use magnetically induced currents in metallic strings as signal sources. However, the present invention is directed to impovements not to be found in these patents.

It is a primary object of the present invention to provide a stringed instrument and associated electronic circuitry which is able to produce a much greater variety of timbres than a conventional stringed instrument and amplifier is able to.

Another object of this invention is to provide a means for providing the musician more precise control over the sound produced by the instrument. This includes control over the following attributes of the strings' signals, both absolute and relative to one another: loudness, frequency response characteristic (or "tone"), harmonic distortion, intermodulation distortion between the signals of the various strings and of each signal, artificial reverberation and/or echo, the time decay envelope, harmonic balance of the total string's signal, etc. Another object of this invention is to provide an instrument to the musician enabling him, with this single instrument, to simulate the characteristic tones of a great variety of available musical instruments, both electric and acoustic.

A further object of this invention is to provide a signal pickup means which does not rely on magnet poles or other devices projecting from the face of the instrument body so far as to impede the plucking motions of the musicians' hands, and yet which still faithfully produces electrically a signal containing a large number of string harmonics, thus insuring a subtle and satisfying musical tone without necessarily relying on the electronic modification mentioned above.

These objects, and other advantages of this invention are partly attained by utilizing as a signal source the electric current induced in a string by the magnetic field or fields of one or more permanent magnets selected from a large variety of such magnets. Said magnets may be made in such a way as to be readily interchangeable and reversible.

Some of said objects and advantages are attained by using the present invention in conjunction with some or all of the following well-known electronic or electromechanical devices to modify each string's signal: loudness controls, tone controls (that is, controls that vary the frequency response characteristic of the amplifier), artificial reverberators, echo chambers, phase distortion devices, amplifiers with non-linear gain characteristics, in particular clipping amplifiers, envelope modifiers, etc.

Some of the preceding objects and advantages are further attained by the use of an electronic circuit to multiply a sum of various of the strings' signals by another or the same sum. The product signal is then mixed with the complete output signal to furnish so-called "ring modulator" effects and other effects familiar to skilled musicians.

In the preferred embodiment of the invention, the magnetic field is established by one or two magnets which are encased in a suitable machinable material, such as plastic. This casing is grooved so as to make easy removal and insertion possible from one of two receptacles built into the body of the guitar. These magnets may be of various constructions and orientations, to allow selection of a variety of tones and sound effects.

At the tuning stops, the strings are connected together and to a low resistance wire mounted close to, but beneath the surface of the fingerboard, and not in contact with the metallic frets common to guitars. This wire serves as a common return path connected to one terminal of the low impedance primaries of transformers, one for each string, mounted internally to the guitar. The other terminal of each transformer primary is connected to the bridge and each string. The secondaries of said transformers are connected to an electronic signal processor or to several such processors. These processors may be mounted either internally or externally to the guitar. Control levers for the signal processors may also be built on the guitar.

A better understanding of the invention will be had by now referring to the preferred embodiments thereof, as illustrated in the accompanying drawings, in which.

Figure 1:
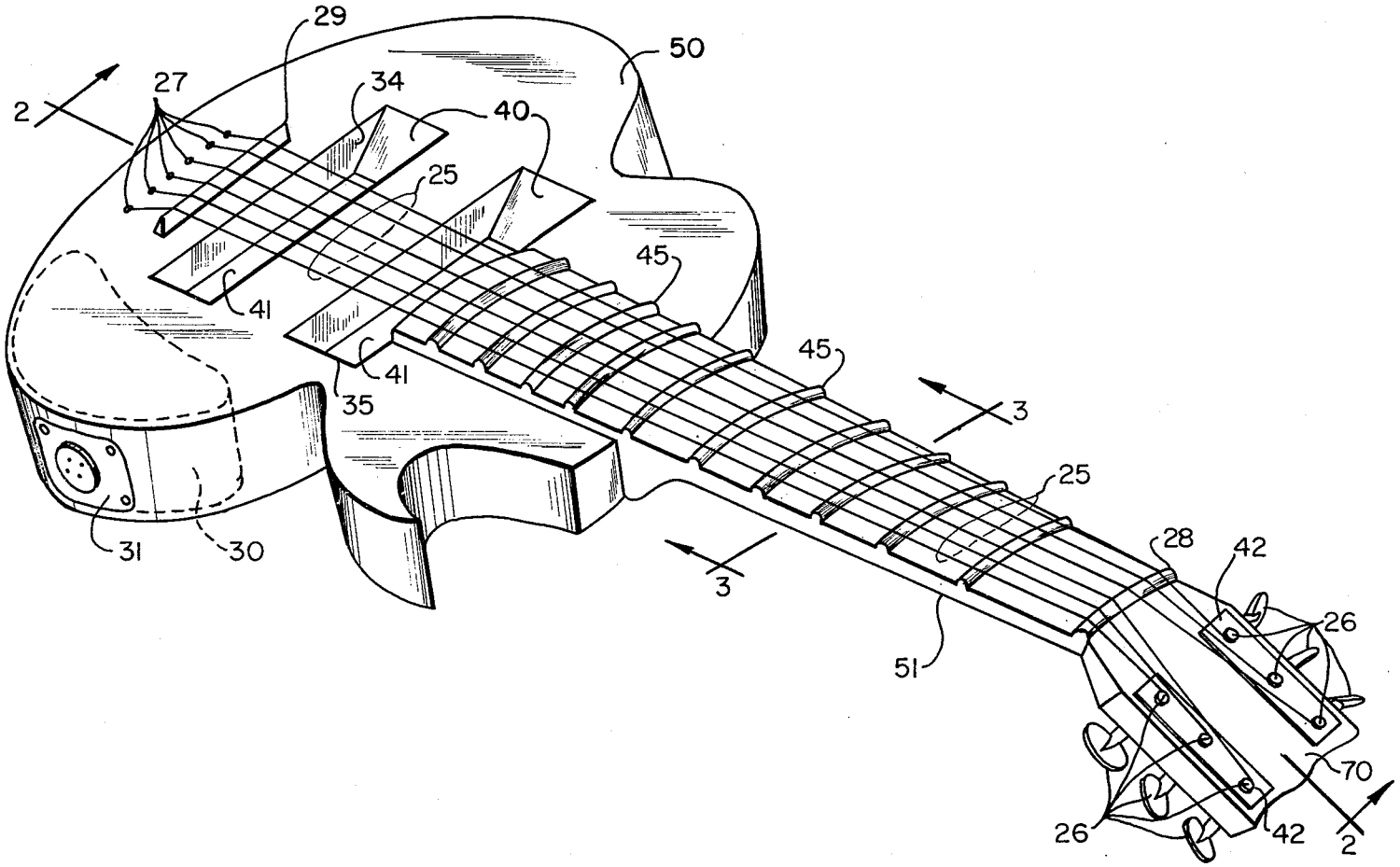
FIG. 1 is a perspective view illustrating the basic electric stringed instrument, the guitar, which is used in a preferred embodiment of the invention.

FIG. 1 shows a stringed instrument in the form of a guitar designed in accordance with the present invention. The guitar includes a body 50 having an elongated neck portion 51. The guitar is fitted with electrically conducting strings, 25. Said strings are fastened and tensioned, and electrical connection to them made, by the tuning pegs 26 at one end and by the string anchor bolts 27 at the other.

The string is supported upon the bridge 29 at one end, and upon the nut 28 at the other end. In this particular embodiment, the bridge must either be made of insulating material, or be a segmented construction of insulator and conductor to insure that no electrical contact between strings exists at the bridge.

At the anchoring bolts 27, electrical connection of the individual strings 25 is made to associated electronic devices (not shown) which may optionally be built into the guitar, for example in an appropriately recessed area 30.

External electrical access to these devices or the guitar strings is made by means of a multipin connector 31. Manual control over the electrical processing of the string output signals may be provided by potentiometers and/or switches projecting from the front face of the guitar body 50 where these controls form part of the processing circuits to be described later.

Figure 5:
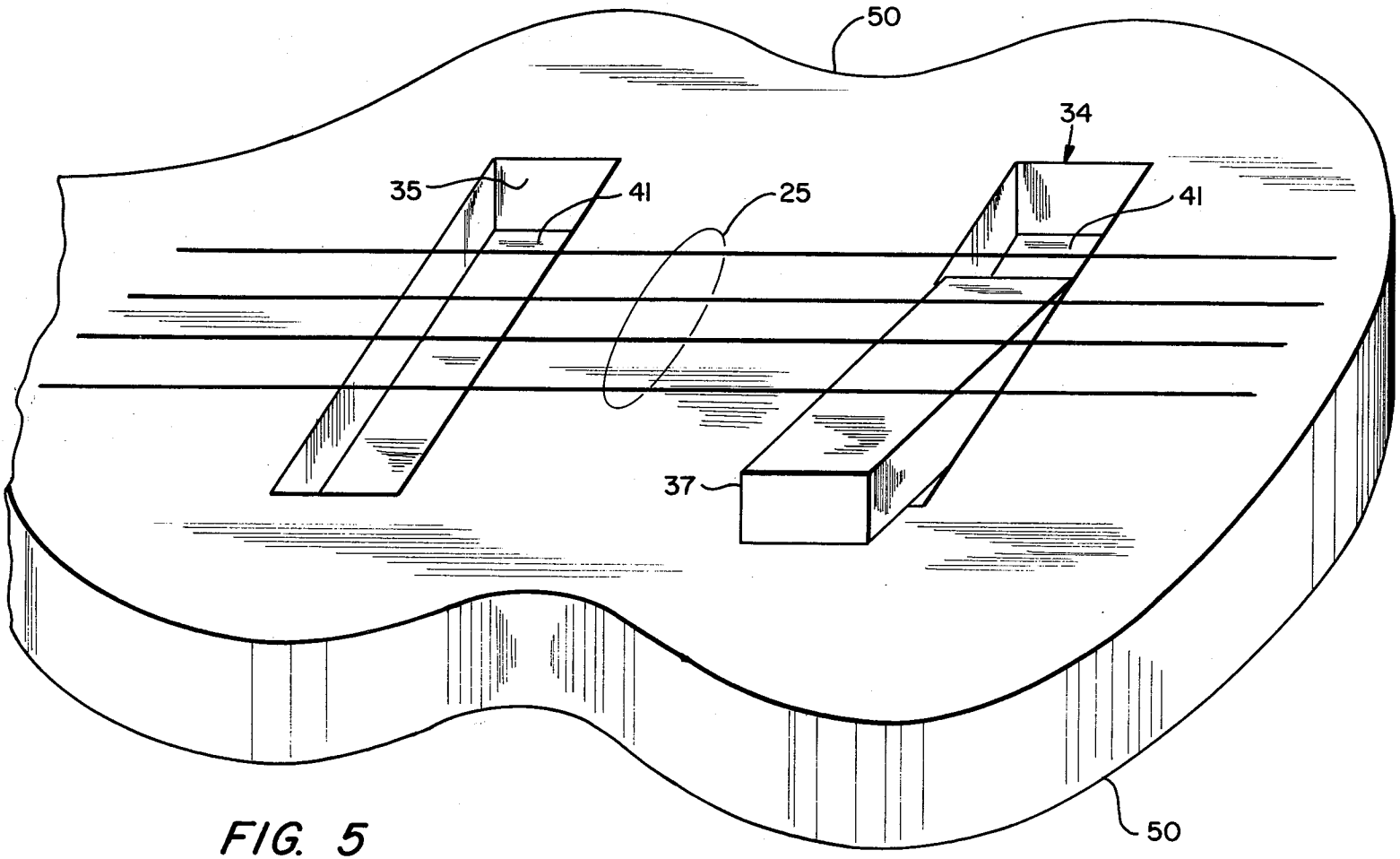
FIG. 5 illustrates in detail one embodiment of a removable magnet and magnet recess.

Recesses 34 and 35 are provided for retaining suitably designed magnets or magnet casings 37, shown in FIG. 5, positioned near the bridge and neck, respectively.

The various locations of the magnet or magnets afford variety in the quality of tones producible with this instrument.

The magnet recesses are provided with ferrous base plates 41 to hold the magnet rigid when in the proper position, but nevertheless to allow easy removal when desired, and oblique sidewalls 40 to allow easy insertion by sliding in said magnet.

Still referring to FIG. 1, metallic strips 42 are employed to connect the tuning pegs 26 (and hence the strings) to the return path wire 43 inside the neck 51.

Figure 2:
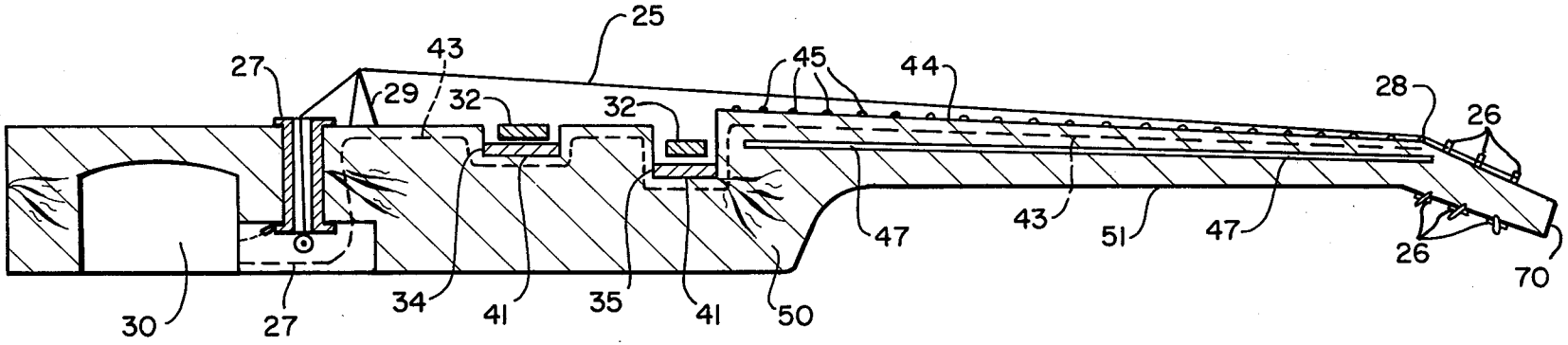
FIG. 2 is a cross section taken along the length of the guitar in the direction of arrows 2—2 of FIG. 1.

Referring now to FIG. 2, which is a crossectional view of FIG. 1 taken along direction arrows 2, said return path is embodied as a single wire 43 connected to said metallic strips 42 and to various electronic devices installed in the body recess 30. Though other forms of return wires or conductors may be employed, it has been observed that, for a single return conductor 43 serving all strings, a single wire of small diameter mounted centrally inside the neck, as close as possible to the surface of the fingerboard 44, is superior to other geometries and placements of said conductor, including wide strips, etc., in that there is less pickup of interfering signals due to external AC magnetic fields.

It should be further noted that said conductor 43 should yet be mounted deep enough inside the neck so that electrical contact to the metallic frets 45 is avoided. Such contact can cause undesired transients due to contact potentials generated by touching the metallic strings 25, to the metallic fret 45. Contact potentials can be completely eliminated by using high resistance or insulating material for the fret.

It should still be further noted that the wire 43 chosen should be of sufficiently high conductivity and large enough diameter so that its resistance compared to the resistance of each string is small enough to avoid voltage drops of appreciable magnitude in this common wire. The generation of appreciable voltage in the common wire would tend to degrade the advantage of interstring isolation possible with this invention.

Figure 19:
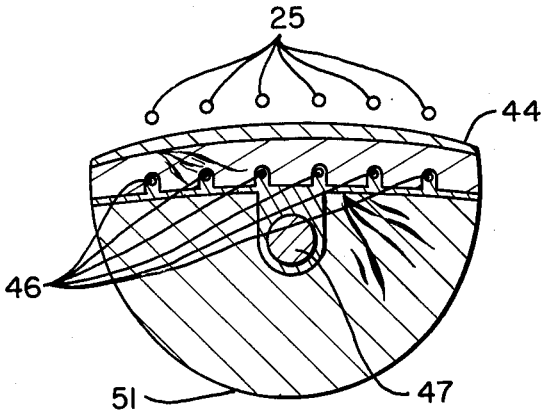

FIG. 19 shows another means for returning the signals from the tuning peg ends of the string to the associated electronics. In this case, the interconnecting strip 42 would be omitted, and a separate wire 46 is connected to each of said tuning pegs 26. These six wires 46 are then run inside the neck 51 under the surface of the fingerboard 44, in a similar manner to above except that in this case, every wire is mounted directly beneath the string whose signal said wire is returning. This method provides an instrument which picks up even smaller levels of interference due to external AC magnetic fields than the method of FIG. 3, and than other possible geometries.

Figure 3:
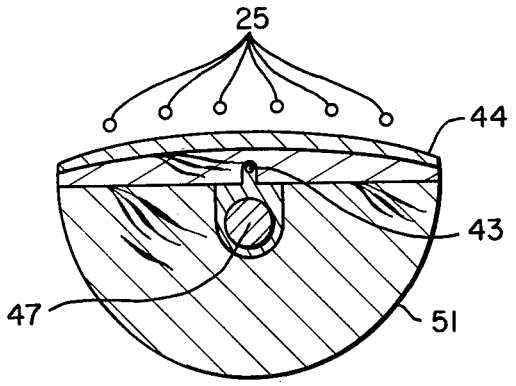
FIGS. 3 and 19 are cross sections of two embodiments of the neck of a guitar taken in the direction of the arrows 3—3 of FIG. 1.

It should be noted that most electric guitars are constructed with a long steel rod 47 called a truss rod mounted coextensive with, and internal to, the neck 51 for reasons of mechanical strength, and that this rod is typically placed in a groove in the neck close under the fingerboard as illustrated in FIG. 3. Should an exceptionally economical instrument be desired, a further method is provided for returning the signal wherein means for interconnecting the tuning pegs 26 are again employed, for example, by the conducting strip 42 depicted in FIG. 1, but in this case, no use is made of any wires such as 43 or 46 mounted internally to the neck, but instead connection is made to said truss rod 47 which then serves as a portion of the return path to the associated electronics 30.

A prior art method for providing an electrical connection of the strings at the tuning stops has used a shunting metallic bar bearing down on the strings between the tuning pegs and the nut to provide electrical contact. The oxide layer which eventually begins to coat guitar strings over a period of use, would probably render the above described more casual method of string contact unreliable. The nut 28, normally made of insulating material, may be replaced with a conducting material to provide the required electrical contact, but the preferred embodiment of this invention makes electrical connection of the strings through the tuning pegs 26, since contact is made at a point of high pressure, which assures a low impedance connection.

Figure 20:
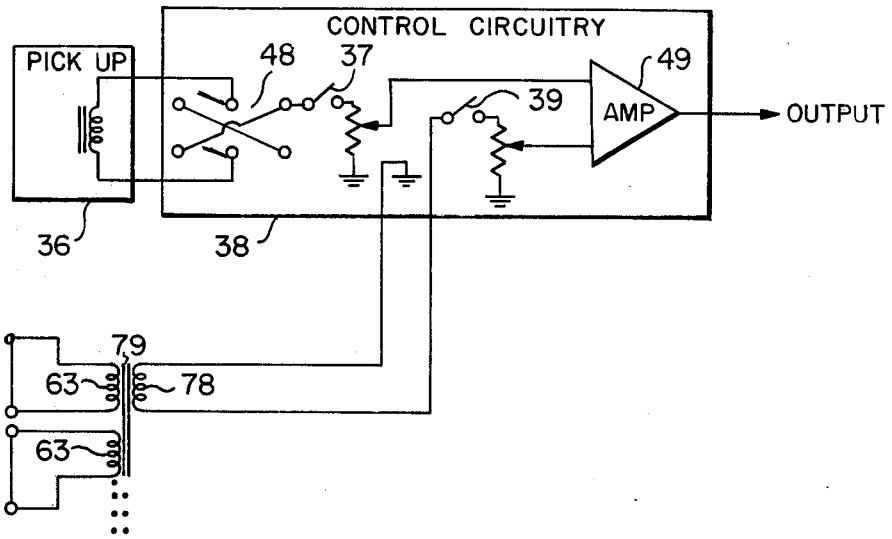
FIGS. 20, 21 illustrate the interconnection of the pickup of this invention with a variable reluctance pickup of the prior art.

FIG. 20 shows in detail one such tuning peg assembly. The pegs are mounted on the extension of the neck is called the headstock 70. The winged key 69 acts through mechanism 68 to turn shaft 67. Shaft 67 has a hole 66 which catches and tensions the string 25. At the point 65 where the edge of the hole catches the string, the most pressure is exerted on the string; hence the most secure is the contact. Even if the edge is not sharp, the shaft 67 bears the full tension of the string and hence is the preferred connection point.

Because of the tension of the string, shaft 67, which is made of metal, presses against sleeve 96, also of metal which is pressed in turn by means of threaded member 68, against metallic washer 95 which in turn presses against grounding plate 42 which is soldered to the wire(s) 43, 46 comprising the return path. This construction thus assures secure electrical contact between the string end and return path.

In the preferred embodiment, the anchoring bolt 27 consists of a threaded bolt securely fastened perpendicularly to the face of the guitar body 50. Said bolt is drilled with a hole large enough to admit the desired string 25. The ball, fastened to a commercially available string, is too large to pass through said hole and thus supports the full tension on the string, thus insuring close contact between ball and bolt because both the bolt and the ball are metallic. A solder lug attached in the usual way to the bolt allows secure electrical connection to said string 25. A separate electrically isolated bolt and solder lug is provided for each string.

FIG. 5 illustrates a reliable magnet mounting method which uses a ferromagnetic material, for instance, plate 41, secured to the bottom of receptacle 34 and thus relies on the magnets in the casing 37 to provide the force for secure mounting of said magnet. Magnet assemblies discussed in this or other patents as utilizing an internal ferromagnetic reluctance-path-shortening plate would dispense with said plate and instead rely on plate 41 for reluctance path reduction, if this mounting method is used.

Patents on the prior art have provided for magnet fields either with an armature type assemblies having small gaps or with extended open-type field structures.

In the former type, the necessity of situating the vibrating string within said small gap impedes the free access to the strings that skillful plucking requires.

In the latter type, the large extent of the magnetic field extends over both nodes and antinodes of the strings' vibration pattern and will thus tend to cancel the shorter wavelengths, corresponding to the higher harmonics. This results in a relatively dull signal consisting mainly of fundamental and lower harmonics.

To meet these objections we provide magnets having dimensions along the string less than $\frac{1}{8}$ of the length of said string, and usually significantly less.

Figure 7:
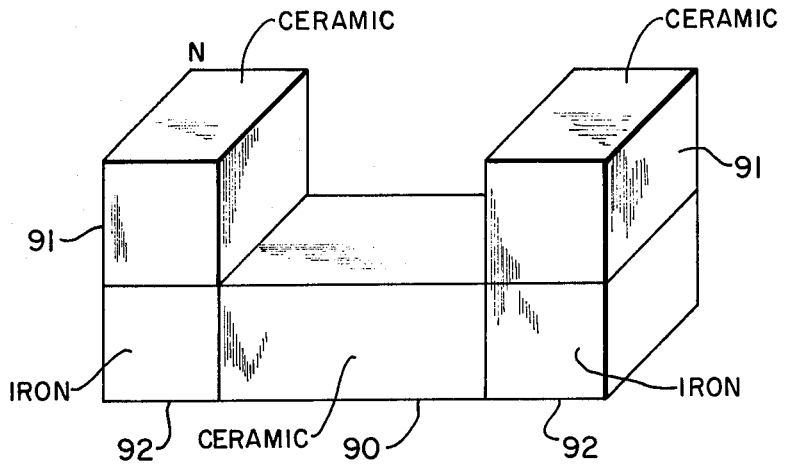
FIG. 7 illustrates a particularly useful transducer magnet construction.
Figure 8:
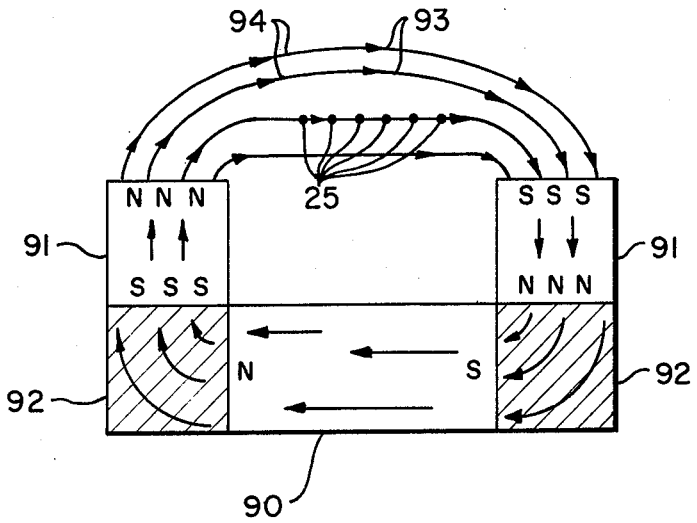
FIG. 8 shows the magnetic field produced by the magnet of FIG. 7.

A particularly useful magnet assembly is shown in FIGS. 7 and 8. It is desirable to provide magnetic field lines as nearly parallel to the frets 45 of the guitar as possible (horizontal field lines). If there is a significant perpendicular component, in addition to the parallel component, the loudness of the induced signal of the plucked string will depend on plucking direction. This is usually undesirable. If there is no parallel component, glissandoes, achieved by the common technique familiar to guitarists of stretching along the fret, will result in rapid attenuation of the string's signal.

The construction shown in FIG. 7 and shown in cross-section in FIG. 8 provides field lines 93 oriented in the desired parallel direction, yet the structure does not project into the plane of strings 25 so as to interfere with the plucking of said strings.

The arrows 94 in FIG. 8 indicate the field direction. The base member 90 and edge pieces 91 are made of highly coercive permanent magnet material, for example, oriented barium ferrite or samarium cobalt. For economic reasons, barium ferrite, far cheaper than samarium cobalt, is used in the preferred embodiments.

These permanent magnets 90, 91 are oriented so that each is at right angles to the adjacent magnet with a ferrous piece at each corner as shown in FIG. 8. The different field directions of magnets 90, 91 are matched by the ferrous corner pieces 92. The pieces 92 may be made of any material of high magnetic permeability, but no preferred orientation. The base member 90 is larger than the width across the strings so that no string 25 is directly above either edge magnet 91. This assembly may be encased in plastic to insure mechanical integrity and form a casing 37.

It can be seen that because of the high coercive force at the top surface of edge pieces 91, the field lines emerge essentially perpendicular to said surfaces, and only after entering the air do they bend, providing a uniform field 93 parallel to member 90 in the region of the string 25, as desired. This type of magnet should preferably extend along the string no more than the wavelength of the eighth harmonic to insure reproduction of all the tone's subtlety. This represents about 3 inches on a standard guitar. This also has the effect of allowing easy removal and insertion of the carrier for said magnet as described above.

Figure 4:
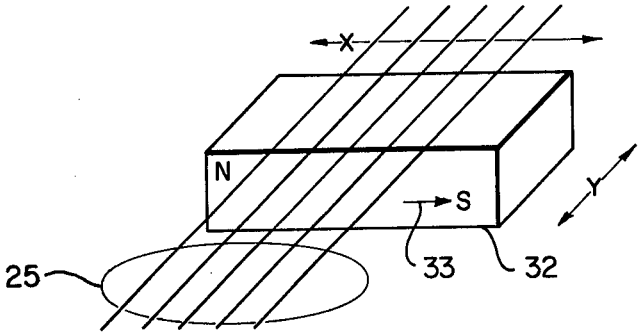
FIG. 4 illustrates the position of a magnet with respect to the strings.

FIG. 4 illustrates a magnet 32 with its magnetic poles oriented as shown by arrow 33 relative to strings 25. Its dimension Y should extend along the string no more than the length of said string (or about 3 inches on a guitar), and dimension X should be at least one inch longer than the breadth across the strings (X = about 3 inches on a guitar). The magnet 32 may be a ceramic bar magnet producing a predominantly horizontal field or it may be the assembly shown in FIG. 7.

As shown in the preferred embodiment of FIG. 1, two magnet slots are provided. Each may be used separately, or two magnets may be used simultaneously. It is occasionally desirable, furthermore, to have the two magnets oriented so that their magnetic field directions are opposed in order to cancel mode signals induced in the string at the two magnet locations. This has the effect of producing a nasal sound well known to musicians who play electric stringed instruments.

In particular, the strengths of the magnets, and the geometrical distribution of their fields, may be specified and weighted relatively so as to cancel completely certain harmonics. Such magnets produce fields satisfying the following equation $$\int_0^L [g_1(x) + g_2(x)] \sin \frac{n\pi X}{L} \, dx = 0$$

where $g_1(x)$ and $g_2(x)$ are functions representing the field strengths of the two magnets as a function of distance X from one end of the string, L is the length of the string, and $n$ is the harmonic that it is desired to cancel.

We now describe an instrument providing various forms of electronic processing applicable selectively and separately to each individual string independent of whatever conditions are imposed on another.

The strings 25, as described previously, are connected at either end ultimately to associated electronics installed within the guitar body 50 at 30. These electronics may consist of simply one or more transformers 52, or additional electronic devices, active and passive. Additional electronic devices may be employed external to the guitar to further modify the tone. Access to said devices is made through connector 31 in FIG. 1 previously described.

Figure 6:
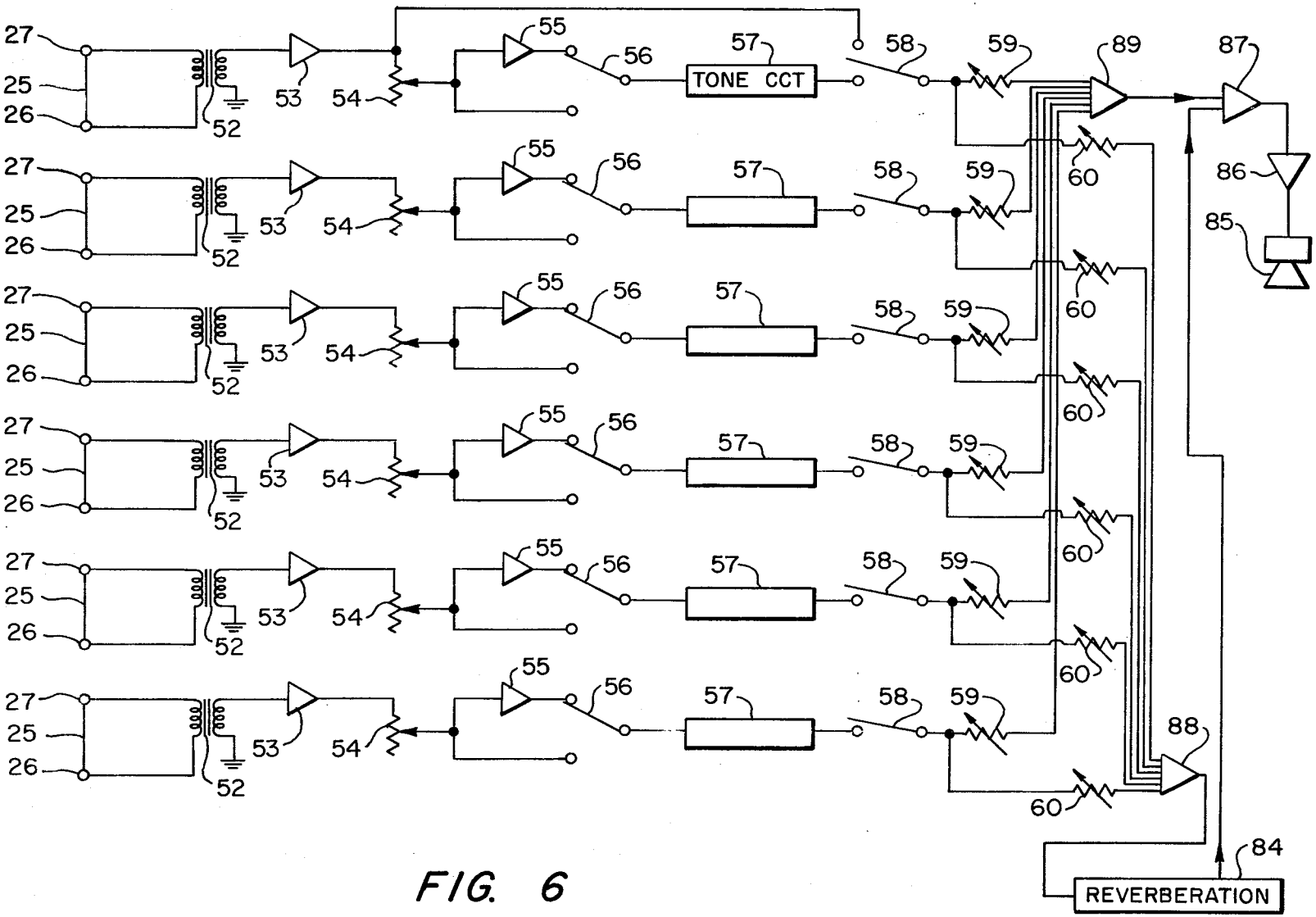
FIG. 6 is a block diagram illustrating schematically one embodiment employing various amplifiers and tone modification devices.

FIG. 6 illustrates how one such processing system may be connected. The strings 25, are connected to the primary windings of transformers 52. The secondary windings of these transformers are then connected to preamplifiers 53. Volume controls 54 may be provided at this stage. Nonlinear amplifiers, for example, clipping amplifiers 55 may be selectively employed to distort the guitar tone by switches 56. Musicians who play the electric guitar frequently use clipping amplifiers to add harmonics and sustaining power to the normal sound of the guitar. This conventional distortion, however, results in the generation of intermodulation distortion when an attempt is made to play chords or several strings simultaneously. This intermodulation distortion is usually undesirable as opposed to the harmonic distortion mentioned above. It will be noted that since in our invention distortion is applied separately to each string prior to mixing the signals from each string together, said intermodulation distortion is eliminated, enabling the musician unprecendented flexibility in specifying a desired amount of harmonic distortion and sustaining power, while retaining the ability to play two or more strings simultaneously.

Referring again to FIG. 6, each amplified signal of a string is connected to cascaded tone modifying circuits 57. Switch 58 is provided to allow the guitarist to rapidly choose between a normal guitar sound and a modified guitar sound. In particular, if circuit 57 has approximately a square law transfer function such as produced by a multiplier, a brighter more percussive tone will be produced when circuit 57 is used. This type of circuitry could not produce the desired percussive effects if used on conventional electric guitars where the lack of electrical signal isolation between strings could yield displeasing intermodulation distortion.

Tone modifying circuits 57 may include devices to modify the frequency response of the system and may also include envelope modifiers or variable phase distortion devices which are commonly used by electric guitarists, or any other of the tone modifiers in common use by musicians.

Potentiometers 59 provide individual loudness control for the modified or distorted tones. This is necessary because after certain types of nonlinear distortion by a device, for example, a clipping amplifier, the loudness of the output signal of said device is not linearly related to the input signal amplitude.

The signals, appropriately weighted by potentiometers 59 are added by summing amplifier 89 and are also weighted by reverberation potentiometers 60 and added in summing amplifier 88. The output signal of amplifier 88 serves as input for the artificial reverberation of echo unit 84.

The output of this echo or reverberation 84 is summed with the output of summing amplifier 89 by summing amplifier 87. This total signal is then amplified by power amplifier 86 and converted to sound by loudspeaker 85.

One alternate embodiment would provide a multiplicity of power amplifiers and loudspeakers, one or more for one or more strings. In this embodiment, summing amplifiers sum only as many signals as is desired to be outputted by a given loudspeaker, and may be omitted entirely. The result is an instrument retaining the control described in the above paragraphs, and in addition providing a novel effect of each string of the guitar seeming to emanate from a different location.

Figure 9:
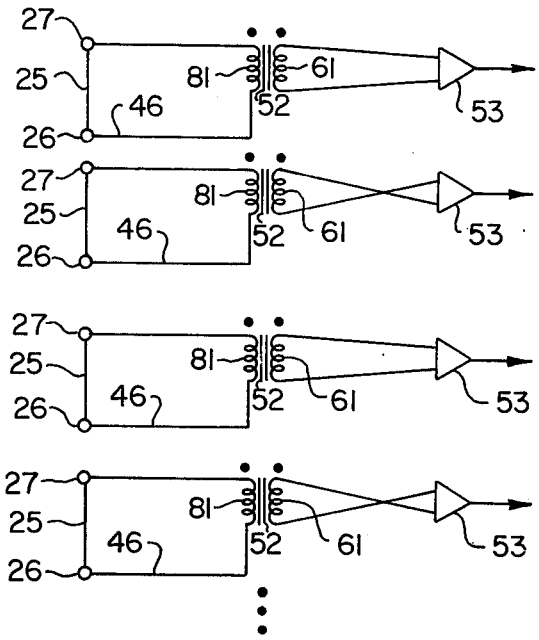
FIGS. 9–12 illustrate various embodiments of string connections to transformers and amplifiers.
Figure 10:
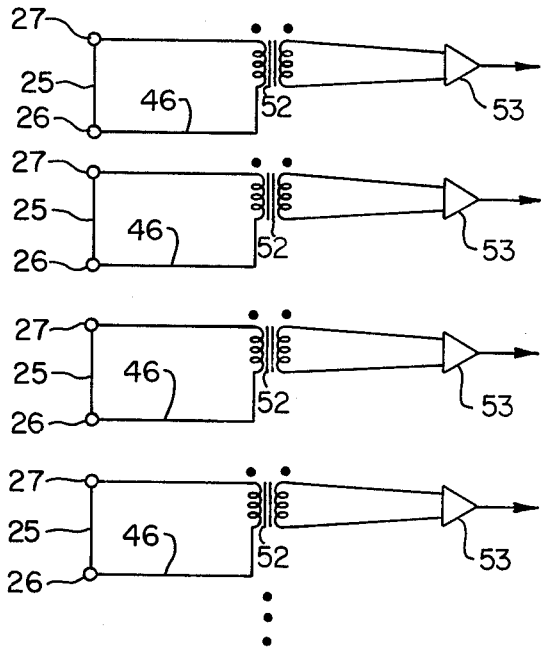

FIG. 9 illustrates one system of alternating the polarity of the transformers 52 connected to the amplifiers, 53 of FIG. 6 termed bucking, to distinguish it from the non-alternating polarity connection, called aiding, depicted in FIG. 10. It has been found, through calculation and experiment, that the bucking configuration of FIG. 9 reduces the amount of external AC field noise in the output signal of amplifier 85 whereas the aiding configuration of FIG. 10 tends to cancel out transient noise due to contact potentials generated by touching a fret to a string in the course of playing.

Figure 11:
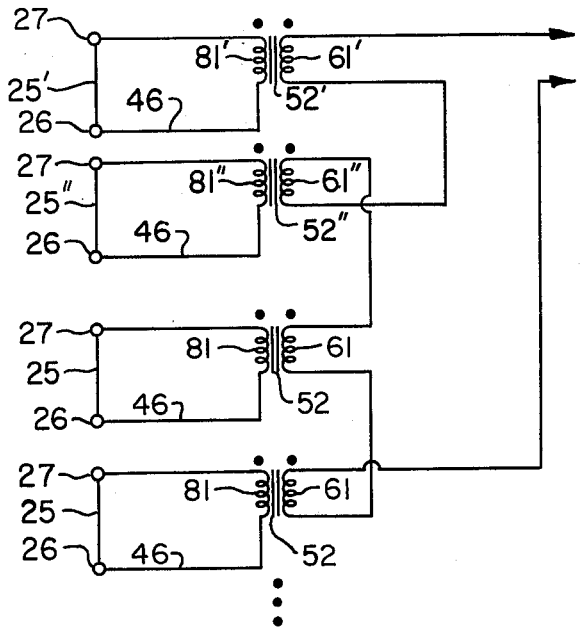
Figure 12:
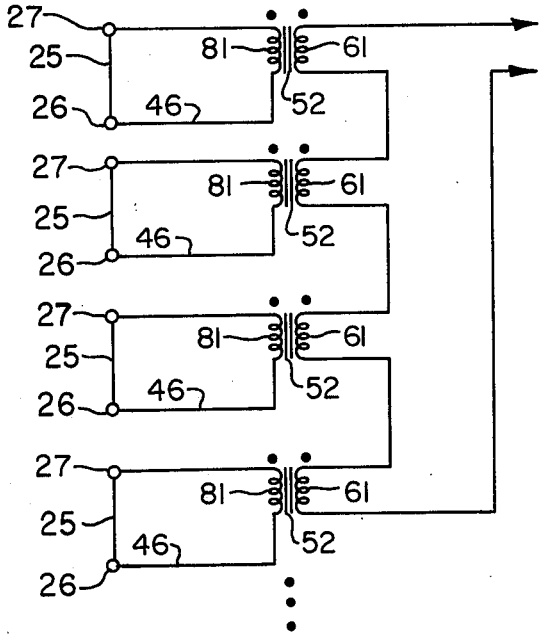

FIGS. 11 and 12, corresponding to FIGS. 9 and 10, respectively above, depict the two connection methods for a guitar having only a single output channel, the mixing being internal to the guitar, and prior to any active electronic processing. Such a guitar may be constructed in the interests of economy, and where it is not considered extremely important to have a separate signal channel for each string.

It will be seen by referring to FIG. 11 that in the bucking configuration, although all the primary windings 81 are connected to the strings 25 in a uniform manner. However, the end of the secondary 61′ of one transformer, 52′ is connected to the opposite end of the secondary 61″ of transformer 52″.

Similarly, in FIG. 9, although there is a uniform connection of primaries 81 to strings 25, a transformer, for example 52′, has its secondary 61′ connected to amplifier 53′ oppositely in polarity as compared to the secondary 61″ of transformer 52″ and amplifier 53″ which are associated with string 25″ immediately adjacent to string 25′ associated with transformer 52′.

It will be seem from FIGS. 12 and 10 however, that in the aiding configuration, both primary and secondary windings are connected with uniform polarity for all channels.

The circuit of either FIG. 9 or 10 which is chosen depends on the relative seriousness with which each of the above problems, contact noise versus AC field noise is regarded. In any event, both forms of noise may be at first reduced by other means, for example, contact potential noise may be reduced by using non-conducting fret material as stated earlier, or by using the separate return path for each string as in FIG. 19 where no common terminal or ground connection exists between the strings, and external AC field induced noise may be reduced by shielding the transformers in a Mumetal ®, steel or other ferrous container.

Figure 13:
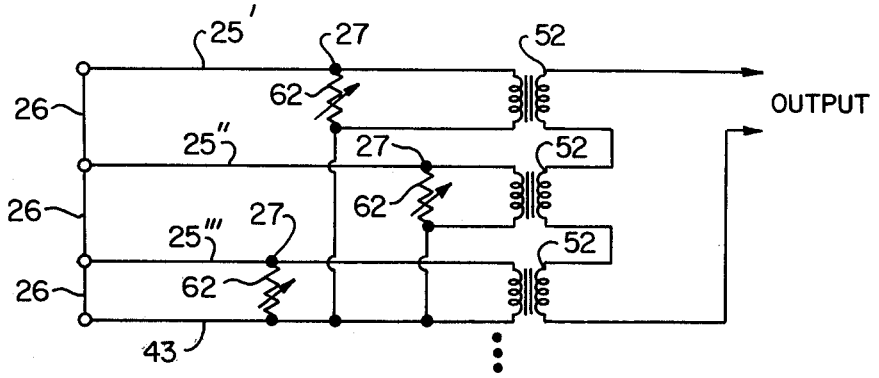
FIGS. 13–16 illustrate various circuits for balancing the loudnesses of the various strings with each other or of allowing the musical control of the individual string loudnesses.

FIG. 13 illustrates one way selective control of the volume of each string is achieved on such an instrument having only a single channel output. A variable or adjustable resistor, 62, is connected in parallel with string 25 thus shunting away current that would normally excite the associated transformer 52, thereby reducing the level of signal of string 25 with respect to those of the other strings. The lower the value of resistor 62, the smaller will be the output signal of string 25. The resistors 62 should have resistance levels roughly comparable to those of the associated strings.

Figure 14:
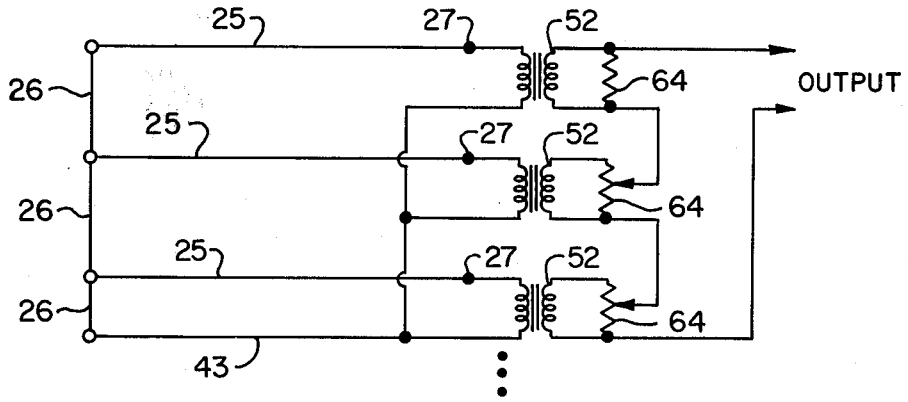

FIG. 14 illustrates an alternate way to accomplish the same result using voltage divider type volume controls 64 on the transformer 52 secondaries. The resistances of these potentiometers 64 should be much greater than the square of the turns ratio of the transformer times the resistance of the associated string.

Figure 15:
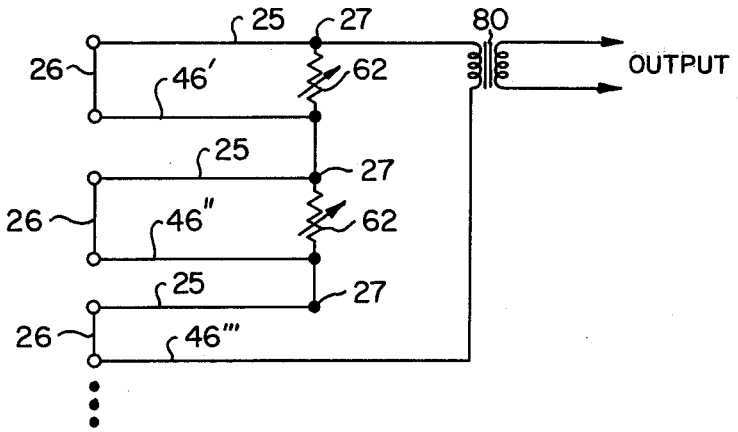

FIG. 15 shows a method similar to that of FIG. 13, but involving the use of only a single transformer 80 rather than a multiplicity with series connection of the secondaries, as in FIG. 13.

Figure 16:
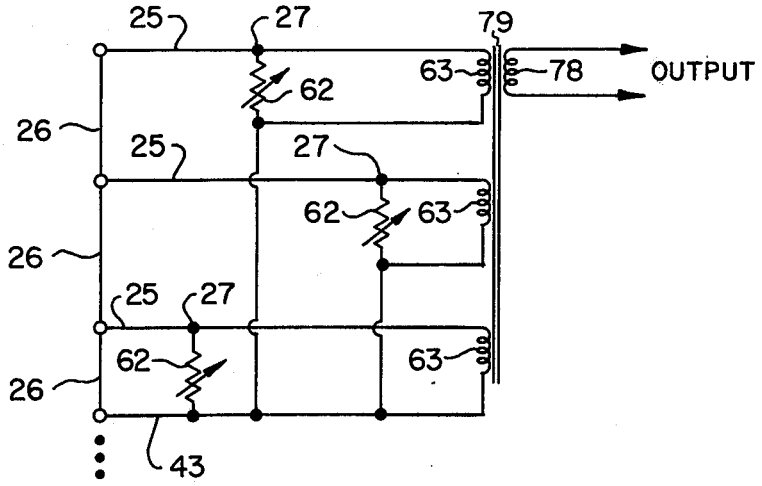

FIG. 16 shows a method for selective volume control of the strings again similar to that in FIG. 13, but utilizing a single transformer 79 with one secondary winding 78 and a multiplicity of primary windings 63, each connected to each of the strings 25. To insure a balanced loudness across all strings fixed resistors may be used instead of the variable ones described, after the appropriate values have been determined.

Other ways of passive circuitry volume controls such as resistive shunts across the transformer secondaries suffer from unintended frequency response modification along with the loudness change.

It has been stated that the separation of signals that our guitar achieves enables any amount of distortion (especially harmonic distortion) of a string's output without causing intermodulation distortion between strings. Nevertheless, since some musicians prefer a certain amount of this type of distortion, and it is characteristic to the sound of a conventionally distorted or "fuzzed" guitar, we provide the option for this sound by means of a circuit, diagrammed in FIG. 17.

Figure 21:
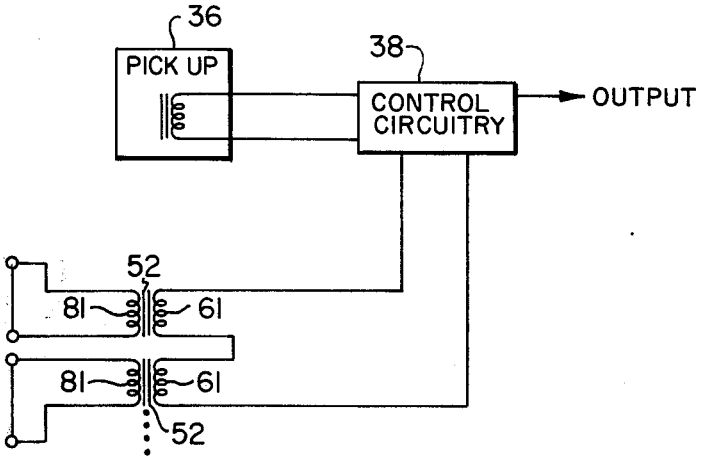

FIGS. 20, 21 show a conventional variable reluctance coil type pickup 36 and the secondary coil 78 or coils 61 of a portion of the single output circuits of FIGS. 11–16 connected to each other in a control circuit 38 which contains conventional switches and volume controls. The pickup 36 is used instead of one of the two magnets 32 of FIG. 2. The pickup 36 and magnet 32 are thus near the neck and bridge of the instrument. The circuits of FIGS. 20, 21 have the capability of providing for rapid switching between the signal produced by the pickup 36 and that produced by magnet 32 by switches 39; and capability of providing for aiding and bucking configurations by switch 48 in conjunction with summing amplifier 49.

Various prior art string pickups having diffuse fields cannot effectively be used as above with conventional variable reluctance pickups, because the diffuse field would be dominated by the concentrated field caused by the variable reluctance pickups permanent magnets. Also these diffuse fields are primarily perpendicular to the plane of the strings and would therefore reject sliding tones or glissandoes. Furthermore, the large magnet assembly for the prior-art-string-type pickup limits the choice of placement of the conventional pickup.

The magnets of this invention, however, are designed to produce strong concentrated fields, stronger than the fields of the permanent magnets of the prior art. Such concentrated fields will not interfere with the operation of the variable reluctance type pickup, since only fields coincident with the coil of said pickup will generate a signal in said coil.

Figure 17:
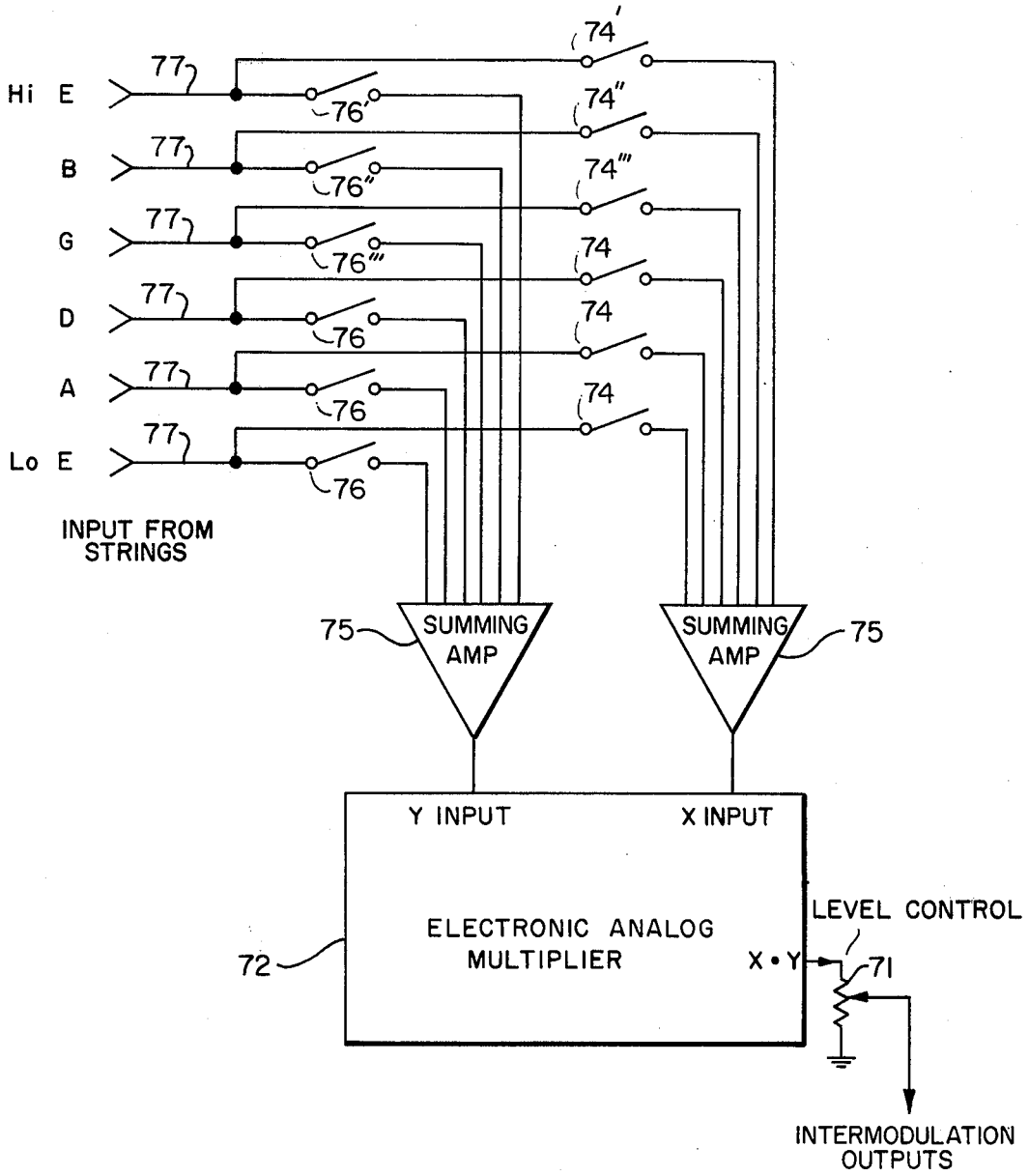
FIG. 17 illustrates a circuit for producing and controlling intermodulation distortion.
Figure 18:
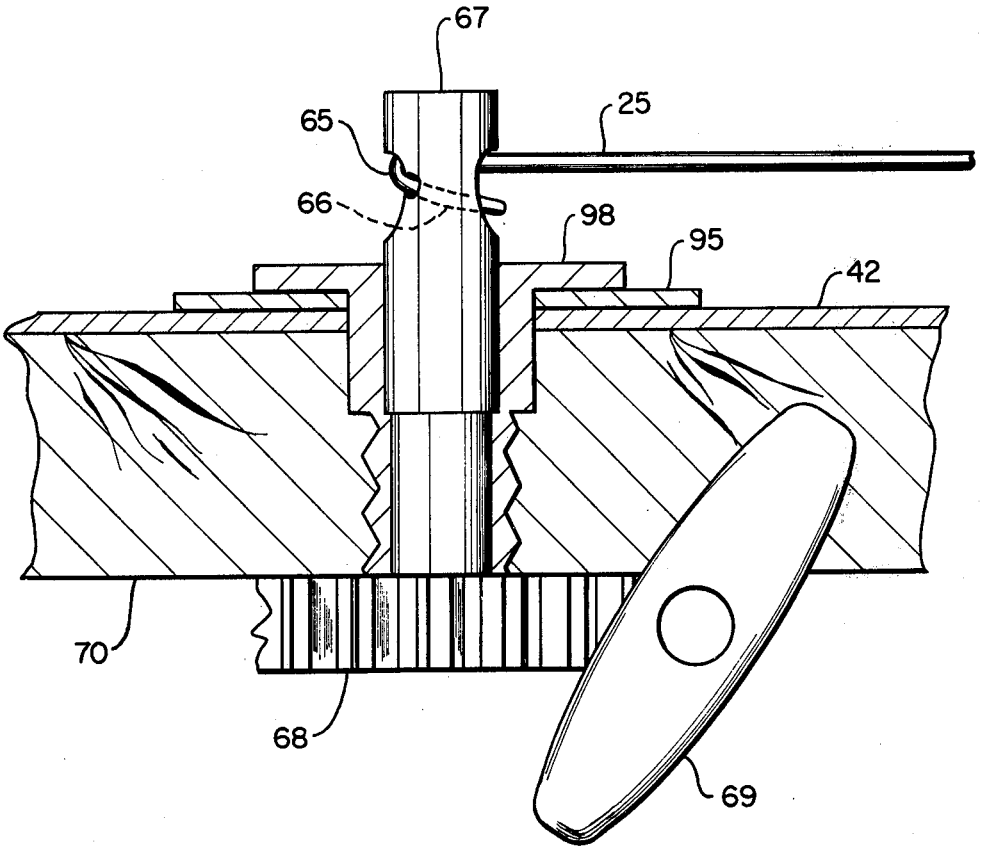
FIG. 18 shows a tuning peg and connection means in detail.

For example, referring to FIG. 17, connectors 77 introduce the signals from the strings into the circuit. Switches 76 select which channels are mixed by summing amplifier 75. Similarly, switches 74 select which channels are mixed by summing amplifier 73.

The output signals of these summing amplifiers 75 and 73 are multiplied by the electronic analog multiplier or modulator unit 72.

The output of this multiplier and hence the relative amount of intermodulation distortion in the total output signal is controlled by potentiometer 71. The construction of analog multipliers and summing amplifiers is well known and a great variety of circuits for either are possible.

It will be noted that to produce any signal from this device, at least one of switches 76, and one of switches 74 must be closed, since multiplication by zero yields zero.

To illustrate one mode of operation, one could close switch 76' and 76'', and switch 74''' to produce an output signal which comprises intermodulation between the high E and G strings and between the B and G strings, but no others.

More than one of these circuits could be used together to provide several intermodulation outputs (say, between different sets of strings). These could be summed into one amp.

The intermodulation output(s) can either be mixed in with the total guitar output signal, or be connected to a special power amp and speaker.

From the foregoing description it will be evident that the present invention has provided a greatly improved electrical stringed instrument affording greater flexibility to the musician in the types of sounds producible and in the simulation of many other types of guitar sounds.

It is evident that those skilled in the art, once given the benefit of the foregoing disclosure, may now make numerous other uses and modifications of, and departures from the specific embodiments described herein without departing from the inventive concepts. Consequently, the invention is to be construed as embracing each and every novel feature and novel combination of features present in, or possessed by, the apparatus and techniques herein disclosed and limited solely by the scope and spirit of the appended claims.

What is claimed is:

1. A stringed musical instrument comprising,
a plurality of electrically conducting strings,
means for processing the electrical signal produced by each string,
a magnet for providing at least one concentrated region of magnetic field in which each string is located, a body for securing said magnet,
said magnetic field being substantially parallel to said body and the plane of said strings at least over the width of the strings,
said magnet extending at least to each outermost string,
wherein said magnet comprises,
a base member and two vertical members of high coercive force permanent magnet material oriented so that the N magnetic field pole of one member is adjacent to the S field pole of the adjacent member,
ferrous corner pieces of high magnetic permeability at the corners where said members meet to bind the magnetic field at each corner,
the combination of the members and corner pieces forming a U-shaped magnet whose magnetic field lines are essentially parallel to the base member.

2. The instrument of claim 1 in which a
means for changing the magnet is provided and comprises
at least one recess in the body of the instrument under the strings between the bridge and the neck of the instrument,
means for holding a magnet in said recesses,
said magnet being capable of being inserted and removed without disturbing said strings.

3. The instrument of claim 1 wherein
said instrument has tuning frets along the neck thereof
said tuning frets being made of electrically insulating material.

4. The instrument of claim 1
said instrument has tuning stops to which said strings are attached,
means for electrically connecting said strings to each other at the tuning stops,
an electrical wire attached to said electrical connecting means and mounted in proximity to but under the surface of the fingerboard and not in electrical contact with the frets along the fingerboard,
said return wire providing a common return path for each string to the vicinity of said bridge,
wherein said return wire is formed partly by the truss rod of the instrument, said truss rod being electrically connected to said electrically connected strings at the tuning stops and an electrical connection to said being provided at the rod end nearest the bridge of said instrument.

5. The instrument of claim 2 wherein
said holding means is adapted to allow said magnet to be removed and inserted without requiring the loosening of any of said strings.

6. The recess of claim 5 wherein said recess has an oblique sidewall whose slope facilitates the insertion and removal of the magnet without interference by the strings.

7. The magnet of claim 1 wherein said vertical members of the magnet extend along the string direction for a distance no greater than the wavelength of the eighth harmonic of the fundamental frequency of the string.

8. The instrument of claim 2 wherein the magnets mounted in said recesses have their magnetic poles in opposite directions thereby oppositely directed magnetic fields in the region of the strings.

9. The instrument of claim 2 wherein the field strengths of the magnets as a function of the distance $x$ along the string from one end, $g_1(x)$ and $g_2(x)$ respectively satisfy the equation $$\int_0^L [g_1(x) + g_2(x)] \sin \frac{n\pi x}{L} \, dx = 0,$$

L is the length of the string and $n$ is the harmonic which is attenuated.

10. The instrument of claim 1 wherein said vertical members are legs of high coercivity material, the ends of said legs being substantially in the plane of the strings and the leg ends being spaced from each other by a distance greater than the width of said strings, and said ends of the legs being sufficiently below the strings so that the legs do not interfere with said string.

11. The instrument of claim 1 wherein the vertical members are outside the outermost strings.

12. A stringed musical instrument comprising, a plurality of electrically conducting strings, means for processing the electrical signal produced by each string, means for providing at least one concentrated region of magnetic field in which each string is located, each region being produced by a magnet which extends along said strings for a distance not exceeding one-eighth the length of the string, means for changing the magnet is provided which comprises at least one recess in the body of the instrument under the strings between the bridge and the neck of the instrument, means for holding a magnet removably mounted in said at least one recess, means for holding each magnet in a fixed position in the magnet recesses of said instrument body, said holding means being adapted to allow said magnet to be removed and inserted without requiring the loosening of any said strings, means comprises a ferromagnetic material attached to the bottom of said recess, whereby the attraction force between said magnet and said material secures said magnet within said recess.

13. A stringed musical instrument comprising, a plurality of ferromagnetic electrically conducting strings, means for providng at least one concentrated region of magnetic field in which each string is located, each region being produced by a magnet, means for processing the electrical signal induced in each string by its motion through the field of said magnetic field means, means for combining the processed signals of at least some of said strings to provide a composite signal from said combining means, a variable reluctance coil pickup means producing a signal from the vibration of said strings, said pickup means and said magnetic structure being separated from each other, one being located near the neck of said instrument and the other being located near the bridge of said instrument, means for summing and the relative amplitude and relative phase of the signals produced by said pick up means and said combining means to produce an output signal.

14. A stringed musical instrument comprising means for transducing the mechanical vibrations of each of its strings into an electrical signal unique to each individual string, means for amplifying or otherwise processing said signal both singly and in combination with the signals of other strings, and means for multiplying a sum of the electrical outputs of some of said plurality of strings with the sum of the electrical outputs of another some of said plurality of strings.

15. The instrument of claim 14 comprising in addition means for summing said multiplied sums with the sum of the electrical outputs of some of said strings.

16. A stringed musical instrument having electrically conducting strings in which strings ac signal corresponding to the strings vibrations are induced by the magnetic field of a magnet assembly secured to the body of said instrument by means of a ferromagnetic material attached to the body of the instrument under the said strings, whereby the attraction force between said magnet assembly and said material secures said magnet, said instrument also having means for amplifying or otherwise processing said ac signals from said conducting strings.

17. The instrument of claim 16 wherein said ferromagnetic material is attached to the bottom of a recess under the strings in said body.

* * * * *